US008561234B1

(12) United States Patent
Kring

(10) Patent No.: US 8,561,234 B1
(45) **Date of Patent: *Oct. 22, 2013**

(54) SURGICAL BED CLAMP APPARATUS

(76) Inventor: Bob Kring, Longwood, FL (US)

( * ) Notice: Subject to any disclaimer, the term of this patent is extended or adjusted under 35 U.S.C. 154(b) by 4 days.

This patent is subject to a terminal disclaimer.

(21) Appl. No.: 13/290,927

(22) Filed: Nov. 7, 2011

Related U.S. Application Data

(63) Continuation of application No. 12/504,381, filed on Jul. 16, 2009, now Pat. No. 8,051,515.

(60) Provisional application No. 61/188,662, filed on Aug. 12, 2008.

(51) Int. Cl.
*A61G 13/10* (2006.01)
*A47B 9/06* (2006.01)

(52) U.S. Cl.
USPC ..... 5/658; 5/503.1; 248/229.1; 248/228.3; 248/231.41

(58) Field of Classification Search
USPC ..... 5/658, 503.1; 602/33–35; 403/71, 87, 403/110, 196, 234–236, 256; 248/229.12, 248/229.22, 228.3, 231.41
See application file for complete search history.

(56) References Cited

U.S. PATENT DOCUMENTS

| | | | |
|---|---|---|---|
| 2,276,741 | A | 3/1942 | Schelle |
| 3,046,072 | A | 7/1962 | Douglass, Jr. et al. |
| 3,339,913 | A | 9/1967 | Anderson |
| 4,018,412 | A | 4/1977 | Kees, Jr. et al. |
| 4,122,587 | A | 10/1978 | Weiss et al. |
| 4,487,523 | A | 12/1984 | Monroe |
| 4,526,355 | A | 7/1985 | Moore et al. |
| 4,547,092 | A | 10/1985 | Vetter et al. |
| 4,624,245 | A | 11/1986 | Mullin et al. |
| 4,653,482 | A | 3/1987 | Kurland |
| 4,708,510 | A | 11/1987 | McConnell et al. |
| 4,901,964 | A | 2/1990 | McConnell |
| 5,320,314 | A | 6/1994 | Bookwalter et al. |
| 5,362,021 | A | 11/1994 | Phillips |
| 5,390,383 | A | 2/1995 | Carn |
| 5,400,772 | A | 3/1995 | LeVahn et al. |
| 5,535,973 | A | 7/1996 | Bailey et al. |
| 5,538,215 | A | 7/1996 | Hosey |
| 5,681,018 | A | 10/1997 | Hoftman |
| 5,836,559 | A | 11/1998 | Ronci |
| 6,023,800 | A | 2/2000 | Stickley |
| 6,264,396 | B1 | 7/2001 | Dobrovolny |

(Continued)

*Primary Examiner* — Michael Trettel
(74) *Attorney, Agent, or Firm* — Garvey, Smith, Nehrbass & North, L.L.C.; Charles C. Garvey, Jr.; Julia M. Fitzpatrick

(57) ABSTRACT

A medical table and clamp apparatus provides a medical table having sides and at least one rail extending along a side. A specially configured clamp travels along the rail, the clamp having a non metallic clamp body. The clamp body has a pair of spaced apart appendages with a recess therebetween. An opening such as a metallic, internally threaded sleeve extends through the body. The sleeve has one sleeve end portion in communication with the recess. An externally threaded shaft threadably engages the internally threaded sleeve. A spherically shaped bearing is mounted on one end. A pusher or pressure plate is mounted on the spherically shaped bearing of the shaft with a connection. The pusher plate is supported by the shaft and the spherically shaped bearing within the recess. Each appendage has an end portion that grasps the rail. The pusher plate is movable toward or away from the sleeve.

24 Claims, 7 Drawing Sheets

(56) References Cited

U.S. PATENT DOCUMENTS

| | | | | |
|---|---|---|---|---|
| 6,499,158 | B1 | 12/2002 | Easterling | |
| 6,622,324 | B2 | 9/2003 | VanSteenburg et al. | |
| 6,671,904 | B2 | 1/2004 | Easterling | |
| 6,708,935 | B2 | 3/2004 | Smeed | |
| 7,731,141 | B2 | 6/2010 | Schuerch | |
| 8,051,515 | B1 * | 11/2011 | Kring | 5/658 |
| 2002/0157186 | A1 | 10/2002 | VanSteenburg et al. | |
| 2005/0223494 | A1 | 10/2005 | Ambrose, III et al. | |
| 2007/0290101 | A1 | 12/2007 | Paulig | |

* cited by examiner

SURGICAL BED CLAMP APPARATUS

CROSS-REFERENCE TO RELATED APPLICATIONS

This is a continuation of U.S. patent application Ser. No. 12/504,381, filed Jul. 16, 2009 (issuing as U.S. Pat. No. 8,051,515 on Nov. 8, 2011), which is a nonprovisional of U.S. Provisional Patent Application Ser. No. 61/188,662, filed Aug. 12, 2008, each of which are incorporated herein by reference.

Priority of U.S. Provisional Patent Application Ser. No. 61/188,662, filed Aug. 12, 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to surgical bed and a clamp that attaches to the rail of a surgical bed. More particularly, the present invention relates to an improved surgical bed clamp having a specially configured interlocking connection between threaded rotating shaft (e.g. wingnut) and a clamp pressure plate or plates and wherein the clamp body pressure plates and shaft are of a non-metallic material.

2. General Background of the Invention

Operating room tables typically are provided with a rail along one side of the table or along both sides of the table. These rails provide a place for attachment of a clamp. The clamp can be used to secure any number of operating room fixtures, appliances, instruments or tools to the table for use during surgery. Many patents have issued that are directed to surgical tables and related clamping structures. The following table provides an example of such tables, clamping arrangements and clamps. The table lists these patents in numerical order, the order of listing otherwise having no significance.

TABLE

| PAT. NO. | TITLE | ISSUE DATE |
|---|---|---|
| 2,276,741 | Boot Holder | Mar. 17, 1942 |
| 3,046,072 | Accessory Supports for Surgical Operating Tables and the Like | Jul. 24, 1962 |
| 3,339,913 | Accessory Clamping Structure for Surgical Tables | Sep. 05, 1967 |
| 4,018,412 | Bracket for an Operating Table | Apr. 19, 1977 |
| 4,122,587 | Patient Securing Device | Oct. 31, 1978 |
| 4,487,523 | Accessory Clamp for Abductor Bar | Dec. 11, 1984 |
| 4,526,355 | Arthroscopic Leg Holder | Jul. 02, 1985 |
| 4,547,092 | Accessory Clamp for Medical Table | Oct. 15, 1985 |
| 4,624,245 | Hip Displacement Apparatus | Nov. 25, 1986 |
| 4,653,482 | Upper-Extremity Traction Tray Attachment for Operating Tables | Mar. 31, 1987 |
| 4,708,510 | Ball Joint Coupling | Nov. 24, 1987 |
| 4,901,964 | Rail Clamp | Feb. 20, 1990 |
| 5,535,973 | Universal Clamp | Jul. 16, 1996 |
| 5,681,018 | Operating Room Tray System | Oct. 28, 1997 |
| 6,264,396 | Ball Socket Clamping Device | Jul. 24, 2001 |
| 2002/0157186 | Hip Brace Apparatus | Oct. 31, 2002 |
| 6,499,158 | Surgical Table Top and Accessory Clamp Used Thereon | Dec. 31, 2002 |

TABLE-continued

| PAT. NO. | TITLE | ISSUE DATE |
|---|---|---|
| 6,671,904 | Surgical Table Top and Accessory Clamp Used Thereon | Jan. 06, 2004 |
| 6,708,935 | Device for Upper Extremity Elevation | Mar. 23, 2004 |
| 2007/0290101 | Sprinkler Mount | Dec. 20, 2007 |

BRIEF SUMMARY OF THE INVENTION

The present invention provides a medical table and clamp apparatus. In one embodiment, the apparatus includes a medical table or surgical table having sides and at least one rail that extends along a side.

A clamp is provided that travels along the rail, the clamp being of a non-metallic clamp body having a pair of spaced apart appendages with a recess therebetween.

An internally threaded sleeve is provided on the body. In one embodiment, the sleeve can be a metallic internally threaded sleeve that extends through the body, having one sleeve end portion that is in communication with the recess.

An externally threaded shaft engages the internal threads of the sleeve. The shaft is provided with a knob or handle that enables one to rotate the threaded shaft. A non-metallic pusher plate is mounted on a spherically shaped or ball bearing end portion of the shaft, providing a pivotal, ball and socket or articulating connection.

The pusher plate is supported by the shaft and the spherically shaped bearing within the recess of the body. In one embodiment, two pusher plates are provided. One has a flat bearing surface. The other has a concave or curved bearing surface.

Each of the appendages has an end portion that grasps the rail. In one embodiment, the pusher plate is movable toward or away from the sleeve by selective rotation of the shaft in one or another rotational direction. This rotation of the shaft enables a medical implement to be clamped between the pusher plate and the rail.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
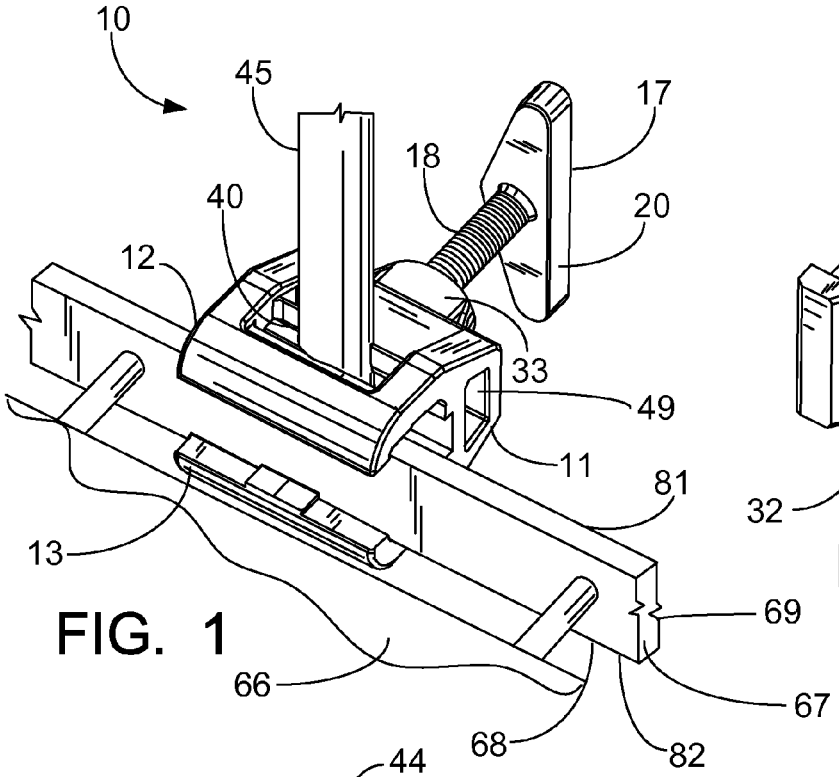
FIG. 1 is a perspective view of a preferred embodiment of the apparatus of the present invention.
Figure 3:
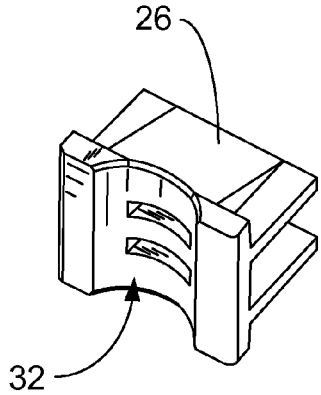
FIG. 3 is a fragmentary perspective view of a preferred embodiment of the apparatus of the present invention illustrating the pusher plate.

FIGS. 1-7 show a preferred embodiment of the apparatus of the present invention, designated generally by the numeral 10. Table and clamp apparatus 10 provides a medical or surgical table 30 having a rail 29. There can be a gap 28 in between rail 29 and table 30. Such tables 30 having rail 29 and gap 28 are commercially available.

In FIGS. 1-2, 5-7 and 12-17 clamp body 11 is provided which has a pair of appendages 12, 13 with a recess 14 therebetween. Clamp body 11 has an internally threaded opening 16 which can be in the form of an internally threaded metallic sleeve 15 that is embedded in body 11. Body 11 is preferably of a non-metallic material such as a polymeric material (e.g. polyamide, nylon) such as Grivory® GV6H or Grivory® GV7H. The non-metallic material of body 11 can be a nylon copolymer, polyamide, or polyphthalamide as examples. Another material would be GRIMALID LVX-65H, a nylon based material that is very strong, arguably some better_properties than the Grivory GV-6H & 7H materials, but it costs about 25% more. The Grivory® products GV6H, GV7H and GRILAMID LVX-65H are sold by EMS Grivory of Switzerland (www.emsgrivory.com).

A wing nut 17 provides an externally threaded shaft 18. The external threads on shaft 18 engage the internal threads of internally threaded opening 16(see FIGS. 5-6). In this fashion, a ball or sphere or rounded member 19 on an end portion of externally threaded shaft 18 opposite knob 17 can be advanced or retracted by rotating shaft 18. A user simply rotates handle or knob 20 of wing nut 17 in a clockwise direction in order to advance ball, sphere or rounded member 19 toward recess 14. A counterclockwise rotation of handle 20 withdraws the ball or sphere or rounded member 19 toward internally threaded opening 16. Shaft 18 handle 20 and rounded member 19 can be of a non-metallic material, such as Grivory® GV6H.

Either of a pair of pressure plates 22, 26 can be attached to the ball, sphere or rounded member 19 of internally threaded shaft 18. Each pressure plate 22, 26 can be of a non-metallic material, such as Grivory® GV6H.

The apparatus 10 of the present invention provides a disconnectable or removable connection between either of the pressure plates 22, 26 and the ball, sphere or rounded member 19 of internally threaded shaft 18. The pressure plate 22 has a flat distal surface 31. The pressure plate 26 has a concave surface 32. A user can select either pressure plate 22 or 26. These respective surfaces 31, 32 enable the clamping of an object 44 having a flat side (or sides) or a rounded object 45 in between the selected pressure plate 22 or 26 and the rail 29 of surgical table 30. Such objects 44, 45 can be for example: IV poles, orthopaedic supports, retractors, harnesses and the like.

A proximal 33 end of clamp body 11 provides collar 23 which can be generally cylindrically shaped. Collar 23 can be reinforced with a plurality of gussets 24. Each gusset 24 extends between an outer generally cylindrical surface 34 of collar 23 and an upper outer surface 35 of body 11 as shown. Side surfaces 36, 37 of body 11 form an acute angle. Each surface 36, 37 forms an obtuse angle with surface 35.

The clamp body has additional outer surfaces 38, 39. The surfaces 38, 39 can be generally parallel. Each surface 38, 39 is an outer surface of an appendage 12, 13. Each appendage 12, 13 has an opening that extends from an outer surface to an inner surface of the appendage 12, 13. Opening 40 extends between outer surface 38 and inner surface 42. Similarly, opening 41 on appendage 13 extends from outer surface 39 to inner surface 43.

The body 11 has body end portions 47, 48. Each end portion has a socket. The end portion 46 has socket 48. The end portion 47 has socket 49. As shown, the sockets 48, 49 can be generally trapezoidal in shape.

Figure 2:
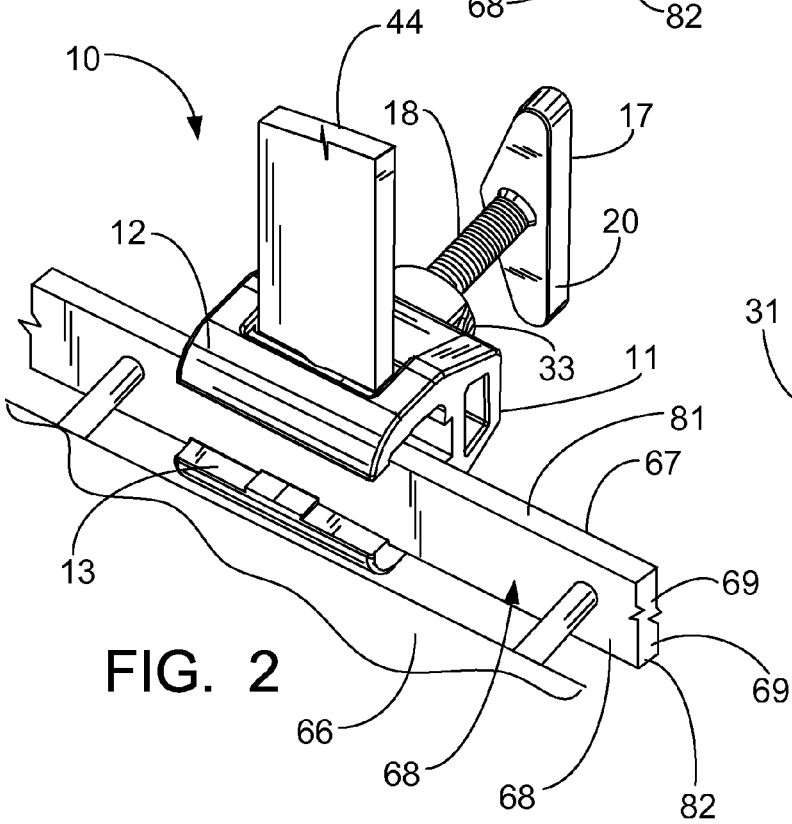
FIG. 2 is a perspective view of a preferred embodiment of the apparatus of the present invention.
Figure 4:
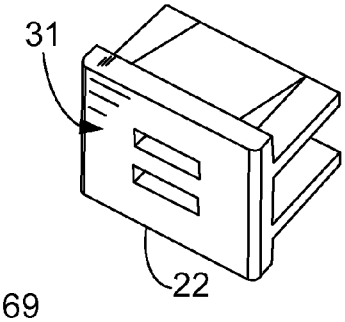
FIG. 4 is a fragmentary perspective view of a preferred embodiment of the apparatus of the present invention illustrating the pusher plate.
Figure 6:
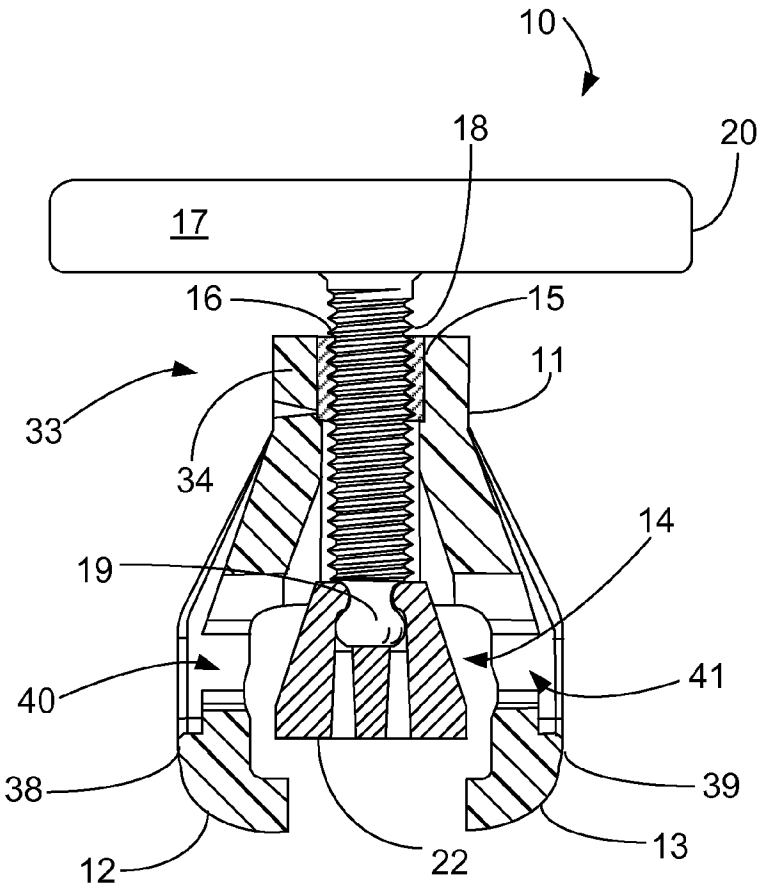
FIG. 6 is a sectional view of a preferred embodiment of the apparatus of the present invention showing the pressure plate in extended position.

Openings 40, 41 that extend through appendages 12, 13 can include rectangular and semi-circular or arcuate sections. For example, in FIG. 16, the opening 40 can include a generally rectangular section 50, a semi-circular section 51 and an arcuate or curved section 52. If the apparatus 10 is clamping an object 44 having flat sides as shown in FIG. 2, that object 44 would basically occupy the rectangular section 50 of opening 40 or 41. The semi-circular 51 and arcuate section 52 can combine to provide a generally circular space for receiving the generally cylindrically shaped object 45. Body 11 could be sized to accommodate objects 45 of a given diameter.

In FIGS. 19-23, pressure plate 22 is shown in more detail. Pressure plate 22 provides a first plate 55 to which are attached a pair of flanges 57, 58. Openings 56 are provided in plate 55. A recess 59 is provided in between flanges 57, 58. Wedges 64, 65 can be used to reinforce flanges 57, 58 respectively as shown.

Figure 5:
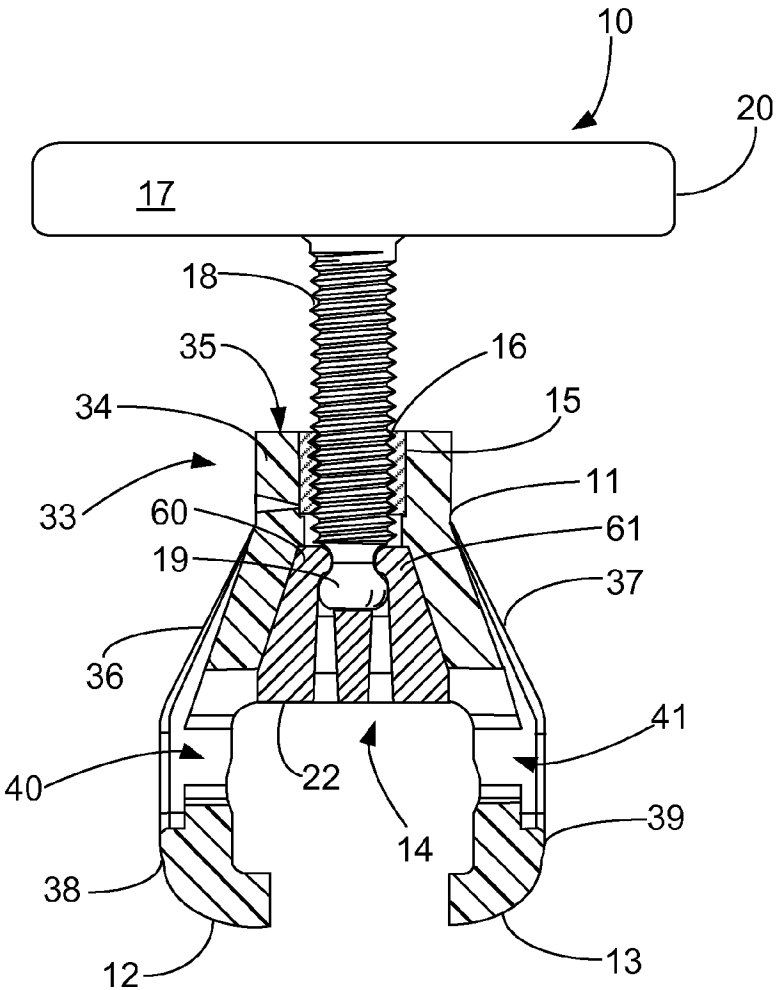
FIG. 5 is a sectional view of a preferred embodiment of the apparatus of the present invention showing the pressure plate in retracted position.
Figure 7:
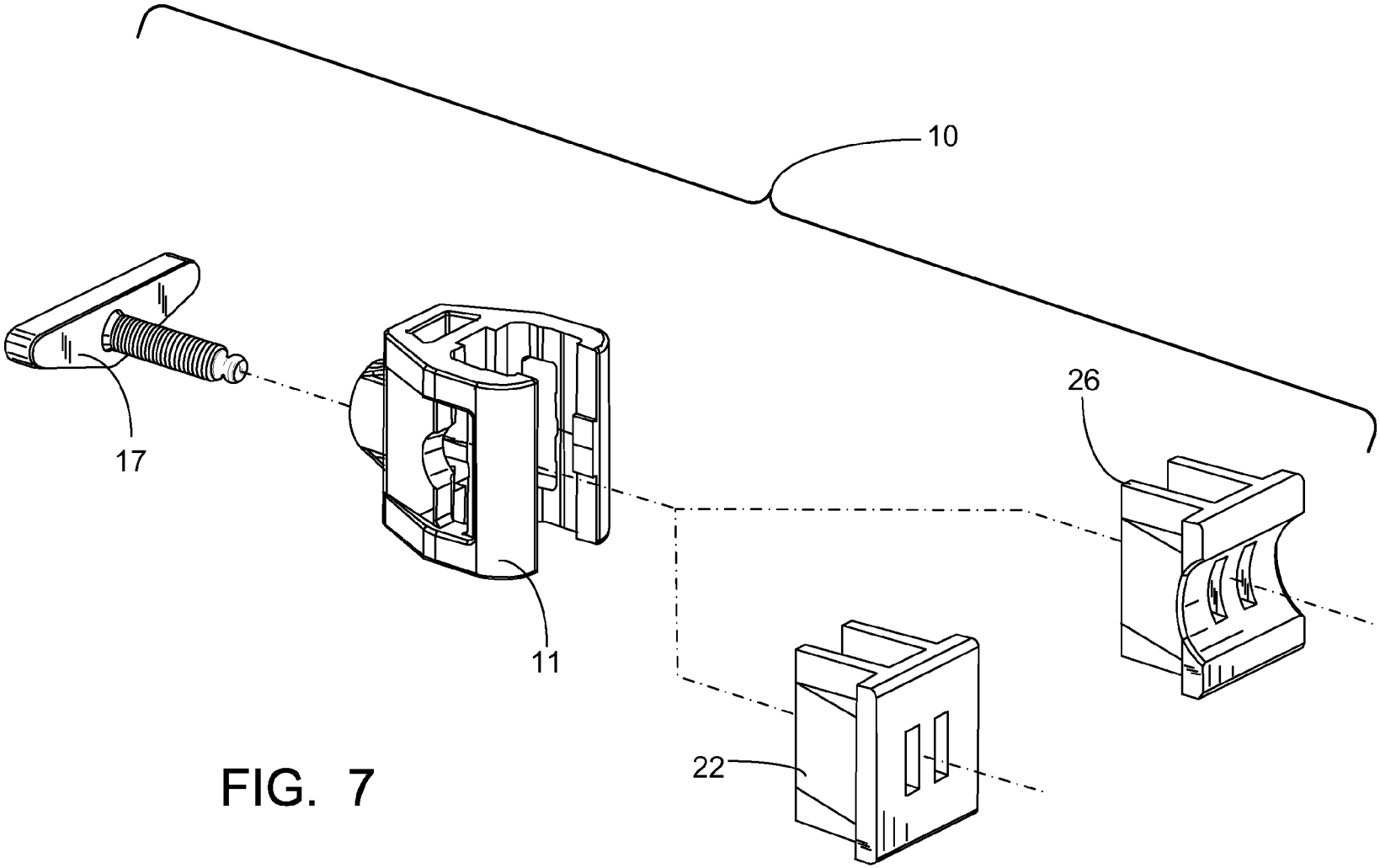
FIG. 7 is a perspective exploded view of a preferred embodiment of the apparatus of the present invention.
Figure 8:
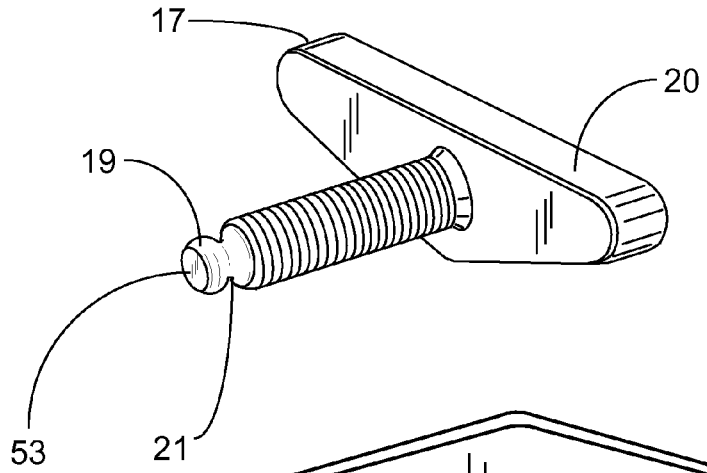
FIG. 8 is a partial perspective view of a preferred embodiment of the apparatus of the present invention illustrating the wing nut.
Figure 10:
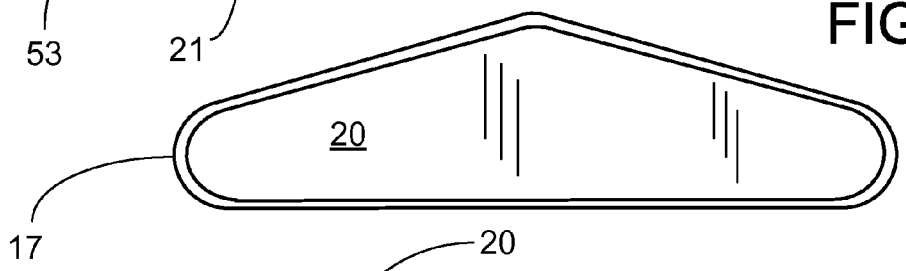
FIG. 10 is an end view of the wing nut.
Figure 9:
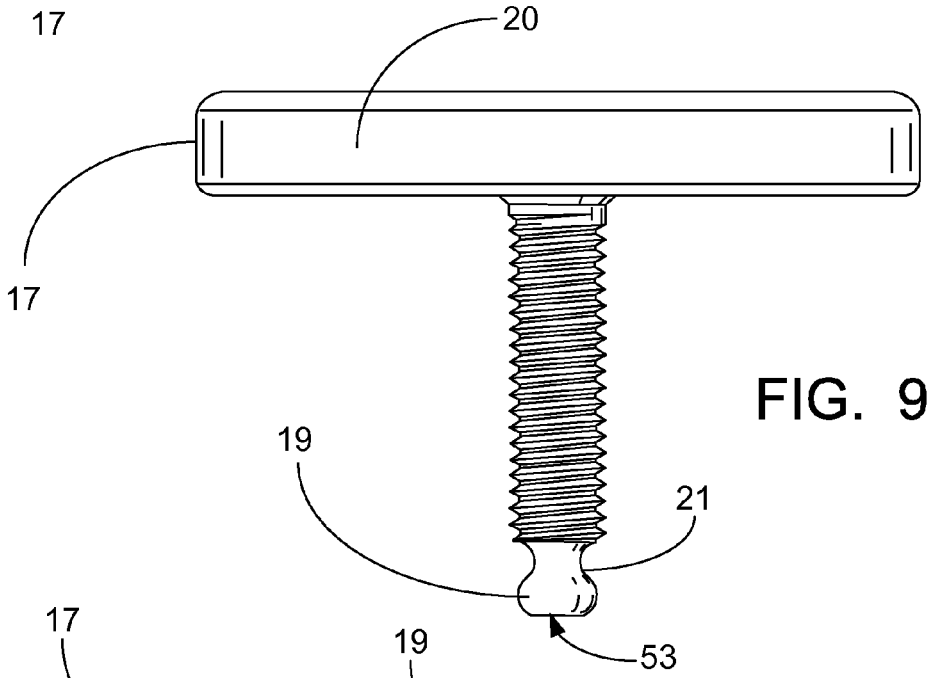
FIG. 9 is an elevation view of the wing nut.
Figure 11:
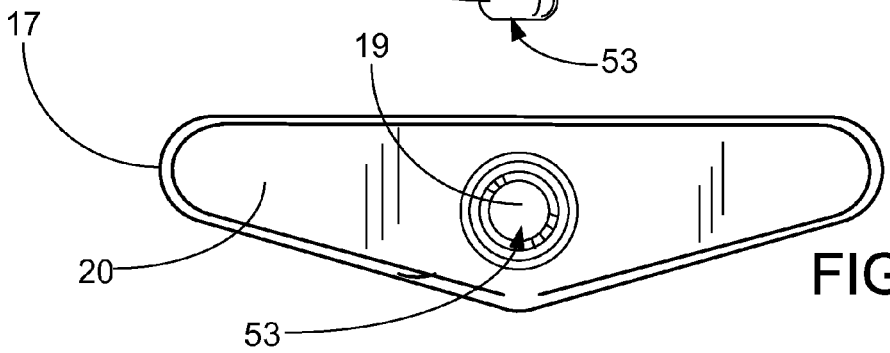
FIG. 11 is another end view of the wing nut.

Shoulders 61, 62 are shaped to engage rounded portion 19 of wing nut 17. In this fashion, when a user wants to retract the selected pusher plate 22 or 26, the shoulders 60, 61 are pulled by the rounded member 19 of wing nut 17 until the position of FIG. 5 is reached. In FIG. 5, the shoulders 60, 61 can be seen conforming to sphere or rounded member 19 at annular recess 21. When the pusher plate 22 or 26 is to be extended for engaging an object 44 or 45, it is moved to the position shown in FIG. 6. When rotating knob or handle 20 in a direction that moves rounded member or sphere 19 away from body 11, an end 53 of rounded member 19 engages bearing pad 62 which is a flat portion of pedestal 63.

Figure 24:
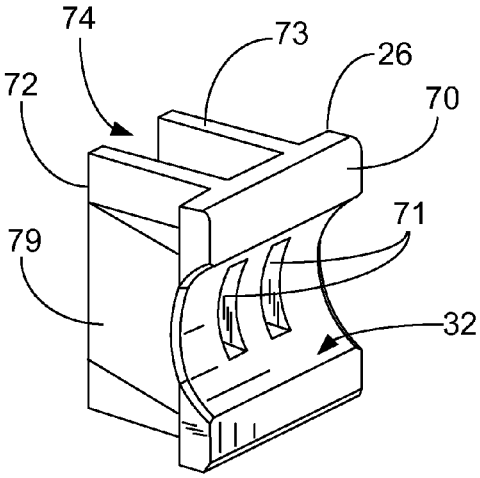
FIG. 24 is a partial perspective view of a preferred embodiment of the apparatus of the present invention illustrating the second version of the pressure plate.
Figure 26:
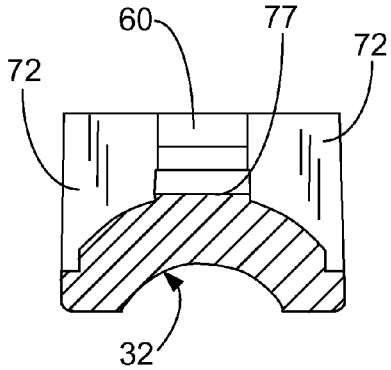
FIG. 26 is a sectional view taken along lines 26-26 of FIG. 25.
Figure 25:
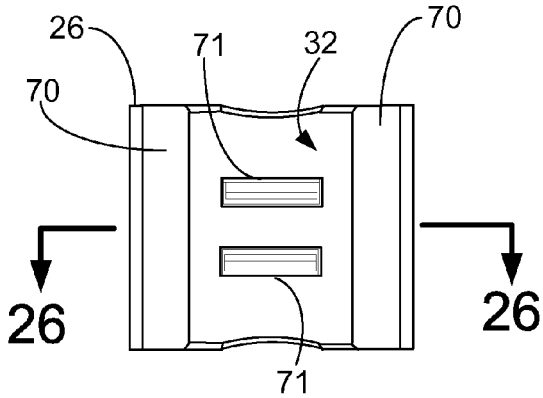
FIG. 25 is a frontal elevation view of the pressure plate of FIG. 24.
Figure 28:
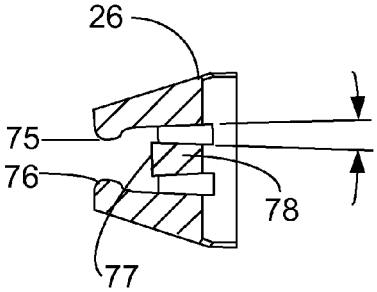
FIG. 28 is a sectional view taken along lines 28-28 of FIG. 27.
Figure 27:
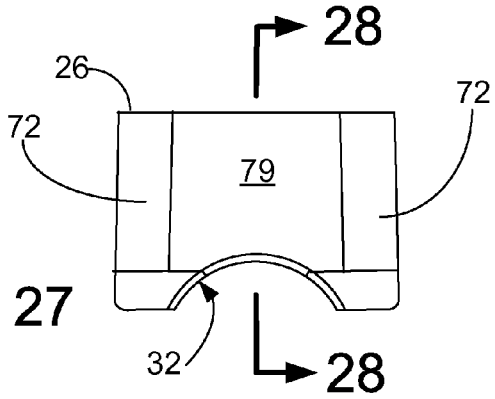
FIG. 27 is a side view of the pressure plate of FIG. 24.

FIGS. 24-28 show pressure plate 26 in more detail. Pressure plate 26 provides a plate 70 having openings 71 at concave surface 32. Plate 70 is reinforced with flanges 72, 73 which can be generally parallel providing recess 74 therebetween as shown in FIG. 24. As with the pressure plate 22, plate 26 provides shoulders 75, 76 that enable rounded member or sphere 19 to pull the pressure plate 26 to the retracted position of FIG. 6. As with pressure plate 22, pressure plate 26 provides a pedestal 78 having bearing pad 77. Wedges 79, 80 are provided for reinforcing flanges 72, 73 respectively. The wedges 79, 80 extend between plate 70 and a flange 72 or 73 as shown in FIGS. 24-28.

The recess 14 includes a tapered section 54 that is sized and shaped to receive either of the pressure plates 22, 26 as shown in FIG. 5 when the knob or handle 20 is rotated counterclockwise, pulling shaft 18 as far as possible away from body 11.

Figure 14:
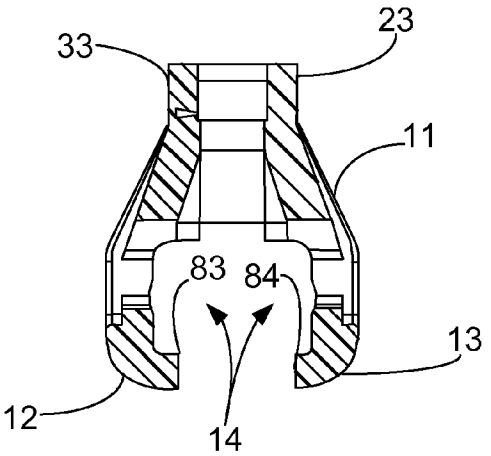
FIG. 14 is a sectional view taken along lines 14-14 of FIG. 13.
Figure 13:
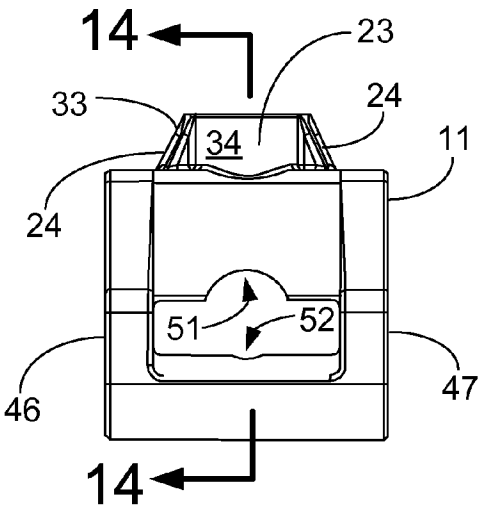
FIG. 13 is a partial side view of a preferred embodiment of the apparatus of the present invention illustrating the clamp body.
Figure 12:
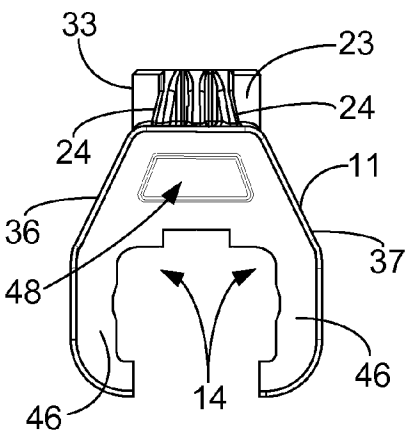
FIG. 12 is a partial side view of a preferred embodiment of the apparatus of the present invention illustrating the clamp body.
Figure 17:
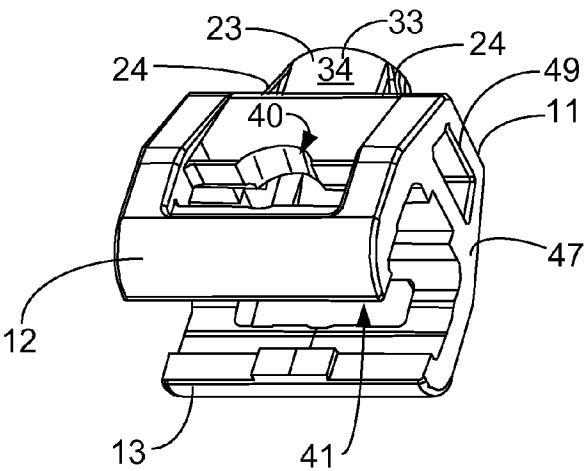
FIG. 17 is a partial perspective view of a preferred embodiment of the apparatus of the present invention illustrating the clamp body.
Figure 16:
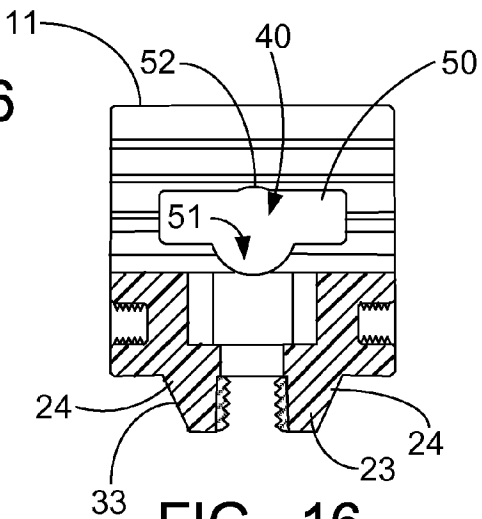
FIG. 16 is a sectional view taken along lines 16-16 of FIG. 15.
Figure 15:
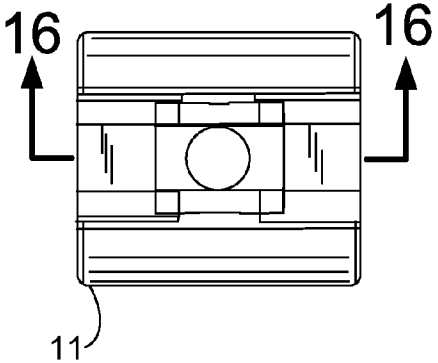
FIG. 15 is a partial bottom view of a preferred embodiment of the apparatus of the present invention.
Figure 19:
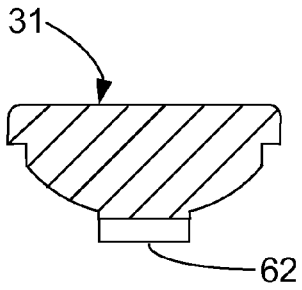
FIG. 19 is a sectional view taken along lines 19-19 of FIG. 18.
Figure 21:
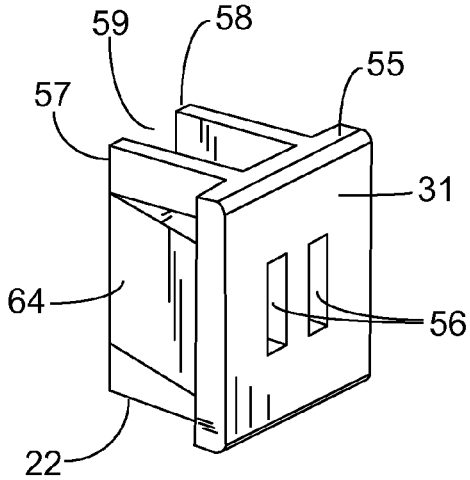
FIG. 21 is a partial perspective view of a preferred embodiment of the apparatus of the present invention illustrating the pusher plate.
Figure 18:
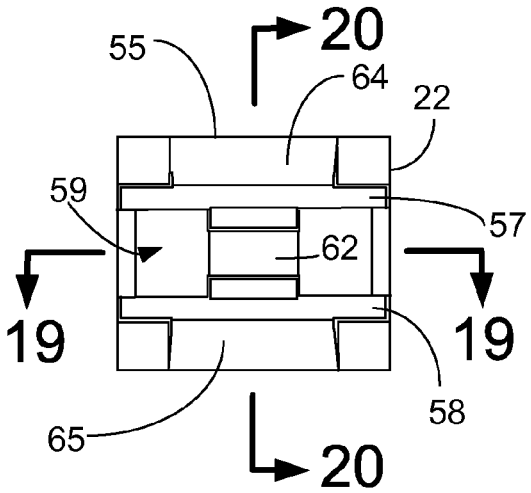
FIG. 18 is a partial bottom view of a preferred embodiment of the apparatus of the present invention illustrating the pressure plate.
Figure 20:
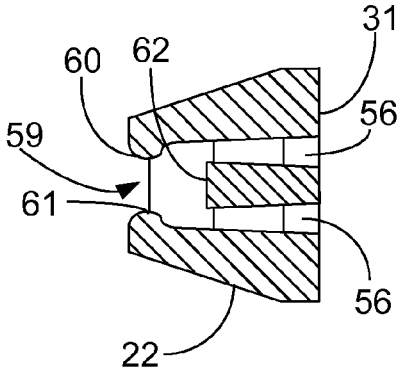
FIG. 20 is a sectional view taken along lines 20-20 of FIG. 18.
Figure 22:
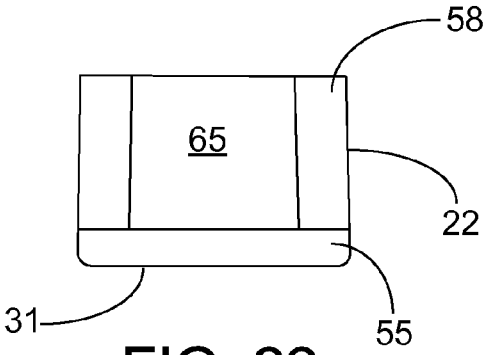
FIG. 22 is a partial elevation view of a preferred embodiment of the apparatus of the present invention illustrating the pressure plate.
Figure 23:
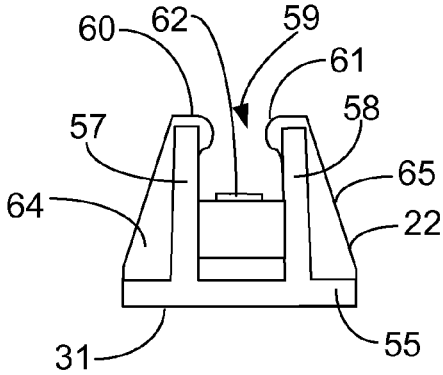
FIG. 23 is a partial end view of a preferred embodiment of the apparatus of the present invention illustrating the pressure plate.

In FIGS. 1 and 2, a surgical or operating room table 66 is shown having a rail 67. Rail 67 has an inner surface 68 and an outer surface 69. Rail 67 has an upper surface 81 and a lower surface 82. FIGS. 1 and 2 show the appendages 12, 13 engaging the rail 67. Note that each appendage 12, 13 has a lip or shoulder that engages the inner surface 68 of rail 67. In FIG. 14, the appendage 12 has shoulder 83. The appendage 13 has shoulder 84.

The following is a list of parts and materials suitable for use in the present invention:

PARTS LIST

| Parts Number | Description |
|---|---|
| 10 | table and clamp apparatus |
| 11 | clamp body |
| 12 | appendage |
| 13 | appendage |
| 14 | recess |
| 15 | sleeve |
| 16 | internally threaded opening |
| 17 | wing nut |
| 18 | externally threaded shaft |
| 19 | ball/sphere/rounded member |
| 20 | handle/knob |
| 21 | annular recess |
| 22 | pressure plate |
| 23 | collar |
| 24 | gusset |
| 25 | socket |
| 26 | pressure plate |
| 27 | ball and socket connection |
| 28 | gap |
| 29 | rail |
| 30 | table |
| 31 | flat distal surface |
| 32 | concave surface |

-continued

PARTS LIST

| Parts Number | Description |
|---|---|
| 33 | proximal end |
| 34 | outer cylindrical surface |
| 35 | outer surface |
| 36 | outer surface |
| 37 | outer surface |
| 38 | outer surface |
| 39 | outer surface |
| 40 | opening |
| 41 | opening |
| 42 | inner surface |
| 43 | inner surface |
| 44 | object |
| 45 | object |
| 46 | body end position |
| 47 | body end position |
| 48 | socket |
| 49 | socket |
| 50 | rectangular section |
| 51 | semicircular section |
| 52 | arcuate section |
| 53 | end |
| 54 | tapered section |
| 55 | plate |
| 56 | opening |
| 57 | flange |
| 58 | flange |
| 59 | recess |
| 60 | shoulder |
| 61 | shoulder |
| 62 | bearing pad |
| 63 | pedestal |
| 64 | wedge |
| 65 | wedge |
| 66 | surgical/operating room table |
| 67 | rail |
| 68 | inner surface |
| 69 | outer surface |
| 70 | plate |
| 71 | opening |
| 72 | flange |
| 73 | flange |
| 74 | recess |
| 75 | shoulder |
| 76 | shoulder |
| 77 | bearing pad |
| 78 | pedestal |
| 79 | wedge |
| 80 | wedge |
| 81 | upper surface |
| 82 | lower surface |
| 83 | shoulder |
| 84 | shoulder |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A medical table and clamp apparatus, comprising:

a) a medical table having sides and at least one rail that extends along a side;

b) a clamp that travels along the rail, said clamp including a clamp body;

c) the clamp body having a pair of spaced apart appendages with a recess therebetween;

d) an internally threaded sleeve extending through the body and having one sleeve end portion that is in communication with said recess;

e) an externally threaded shaft threadably engaged with said internally threaded sleeve;

f) a non-metallic bearing on one end of the shaft;

g) a pusher plate mounted on the bearing of the shaft with a pivotal connection, the pusher plate supported by the shaft and the bearing within the recess;

h) each appendage having an end portion that grasps the rail; and i) wherein the pusher plate is movable toward or away from the sleeve by selective rotation of the shaft in one or another rotational direction for enabling a medical implement to be clamped between the pusher plate and the rail.

2. The medical table and clamp apparatus of claim 1 further comprising an implement that is clamped between the pusher plate and the rail.

3. The medical table and clamp apparatus of claim 2 wherein the implement is an orthopedic brace.

4. The medical table and clamp apparatus of claim 2 wherein the implement is of a non-metallic material.

5. The medical table and clamp apparatus of claim 2 wherein the implement is an I.V. pole.

6. The medical table and clamp apparatus of claim 2 wherein the implement is a surgical brace.

7. The medical table and clamp apparatus of claim 2 wherein the implement is a surgical appliance.

8. The medical table and clamp apparatus of claim 1 wherein the shaft is non-metallic.

9. The medical table and clamp apparatus of claim 1 wherein the body is of a non-metallic material.

10. The medical table and clamp apparatus of claim 1 wherein the pusher plate is a non-metallic material.

11. The medical table and clamp apparatus of claim 8 wherein the shaft is of a non-metallic material.

12. The medical table and clamp apparatus of claim 11 wherein the shaft is of a polymeric material.

13. The medical table and clamp apparatus of claim 12 wherein the shaft is one material selected from a group consisting of nylon, polyamide, nylon copolymer or polyphthalamide or a mixture thereof.

14. The medical table and clamp apparatus of claim 12 wherein the shaft is of a material that includes nylon.

15. The medical table and clamp apparatus of claim 8 wherein the body is of a non-metallic material.

16. The medical table and clamp apparatus of claim 11 wherein the body is of a polymeric material.

17. The medical table and clamp apparatus of claim 12 wherein the body is one material selected from a group consisting of nylon, polyamide, nylon copolymer or polyphthalamide or a mixture thereof.

18. The medical table and clamp apparatus of claim 12 wherein the body is of a material that includes nylon.

19. The medical table and clamp apparatus of claim 8 wherein the pressure plate is of a non-metallic material.

20. The medical table and clamp apparatus of claim 11 wherein the pressure plate is of a polymeric material.

21. The medical table and clamp apparatus of claim 12 wherein the pressure plate is one material selected from a group consisting of nylon, polyamide, nylon copolymer or polyphthalamide or a mixture thereof.

22. The medical table and clamp apparatus of claim 12 wherein the pressure plate is of a material that includes nylon.

23. The medical table and clamp apparatus of claim 12 wherein the shaft includes polyamide.

24. The medical table and clamp apparatus of claim 12 wherein the pressure plate includes polyamide.

* * * * *